United States Patent [19]

Becchi et al.

[11] Patent Number: 4,632,584

[45] Date of Patent: Dec. 30, 1986

[54] SERIAL PRINTER

[75] Inventors: Raffaele Becchi, Ivrea; Felice Giacone, Giaveno, both of Italy

[73] Assignee: Ing. C. Olivetti & C., S.p.A., Turin, Italy

[21] Appl. No.: 594,274

[22] Filed: Mar. 28, 1984

[30] Foreign Application Priority Data

Mar. 30, 1983 [IT] Italy ..... 67354 A/83

[51] Int. Cl.[4] ..... B41J 11/22; B41J 25/28; B41J 5/22; B65D 63/00

[52] U.S. Cl. ..... 400/356; 400/144.2; 400/320; 400/663; 24/270

[58] Field of Search ..... 400/144.2, 175, 355, 400/356, 320, 174, 144.1, 144, 139, 140, 144.4, 144.3, 663, 357; 24/270, 270 SB; D2/408

[56] References Cited

U.S. PATENT DOCUMENTS

| | | | |
|---|---|---|---|
| 2,969,864 | 1/1961 | Hulgate | 400/175 |
| 3,123,194 | 3/1964 | Facius et al. | 400/355 |
| 3,449,800 | 6/1969 | Fisher | D2/408 X |
| 3,951,249 | 4/1976 | Nerbas et al. | 400/356 X |
| 4,134,695 | 1/1979 | Randolph | 400/356 X |
| 4,209,262 | 6/1980 | Savage | 400/144.2 |
| 4,314,770 | 2/1982 | Harre | 400/175 |
| 4,368,563 | 1/1983 | Lentz | D2/408 X |
| 4,377,888 | 3/1983 | Ikesue | D2/408 X |
| 4,444,519 | 4/1984 | Howell et al. | 400/144.2 X |
| 4,469,454 | 9/1984 | Crean | 400/175 X |

FOREIGN PATENT DOCUMENTS

| | | | |
|---|---|---|---|
| 42206 | 12/1981 | European Pat. Off. | 400/175 |
| 2855503 | 7/1980 | Fed. Rep. of Germany | 400/144.2 |

*Primary Examiner*—Edgar S. Burr
*Assistant Examiner*—James R. McDaniel
*Attorney, Agent, or Firm*—Banner, Birch, McKie & Beckett

[57] ABSTRACT

A serial printer comprises a carriage (21) which is movable parallel to a platen roller (11) and on which are mounted a character carrying disc (28) having a flexible blades, a stepping motor (26) for selecting the character to be printed, and a striker hammer (30, 31). The carriage is slidable on a cylindrical guide (17) and is provided with a pair of slider members (62, 63) which co-operate with a fixed bar (18) that is parallel to the guide (17) and to the platen roller (11). Mounted on the fixed bar (18) at the left-hand side of the printer is a key (70) which can co-operate with the slider members (62, 63) of the carriage to disconnect them from the bar (18) and to permit the carriage (21) to be swung down so that the character carrying disc (28) can be easily removed and replaced.

6 Claims, 6 Drawing Figures

SERIAL PRINTER

The present invention relates to a serial printer comprising a print carriage which is movable on a guide that is parallel to a platen roller and which has a slidable element co-operating with a fixed bar that is parallel to the guide, for holding the carriage normally in an operating position. Mounted on the carriage are a character carrying disc of flexible blade type, an electric motor for selecting the character to be printed and the position in front of the platen roller, and a striker arrangement.

In that type of printer, there is always the requirement that it must be possible to have easy access to the character carrying disc for removing and replacing it as required. To do that, since the character carrying disc is normally in a vertical position, with the flexible blades thereof very close to the platen roller, and as the striker arrangement is immediately behind the character carrying disc, the carriage is moved away from the platen roller, by moving it towards a service position which provides the operator with easy access to the shaft of the selector motor to which the character carrying disc is connected.

A serial printer is known in which the guide and the bar on which the print carriage is slidable are mounted on a frame structure which in turn can be tilted with respect to the side portions of a fixed frame structure. In that way, by tilting the carriage together with the frame structure, the character carrying disc can be put into a virtually horizontal position, enabling the operator easily to remove it from its mounting. That technical solution, while permitting the operator to tilt the frame structure and the carriage when the latter is in any position along the line of printing, is however rather complex and expensive.

The object of the present invention is to provide a serial printer which, besides guaranteering a high level of reliability and quality of printing and affording certain typical functions and characteristics such as the possibility of ready access to the character carrying disc, is also very simple and economical.

This object is achieved by the printer according to the invention, which is characterised in the manner set forth in claim 1 below.

Figure 1:
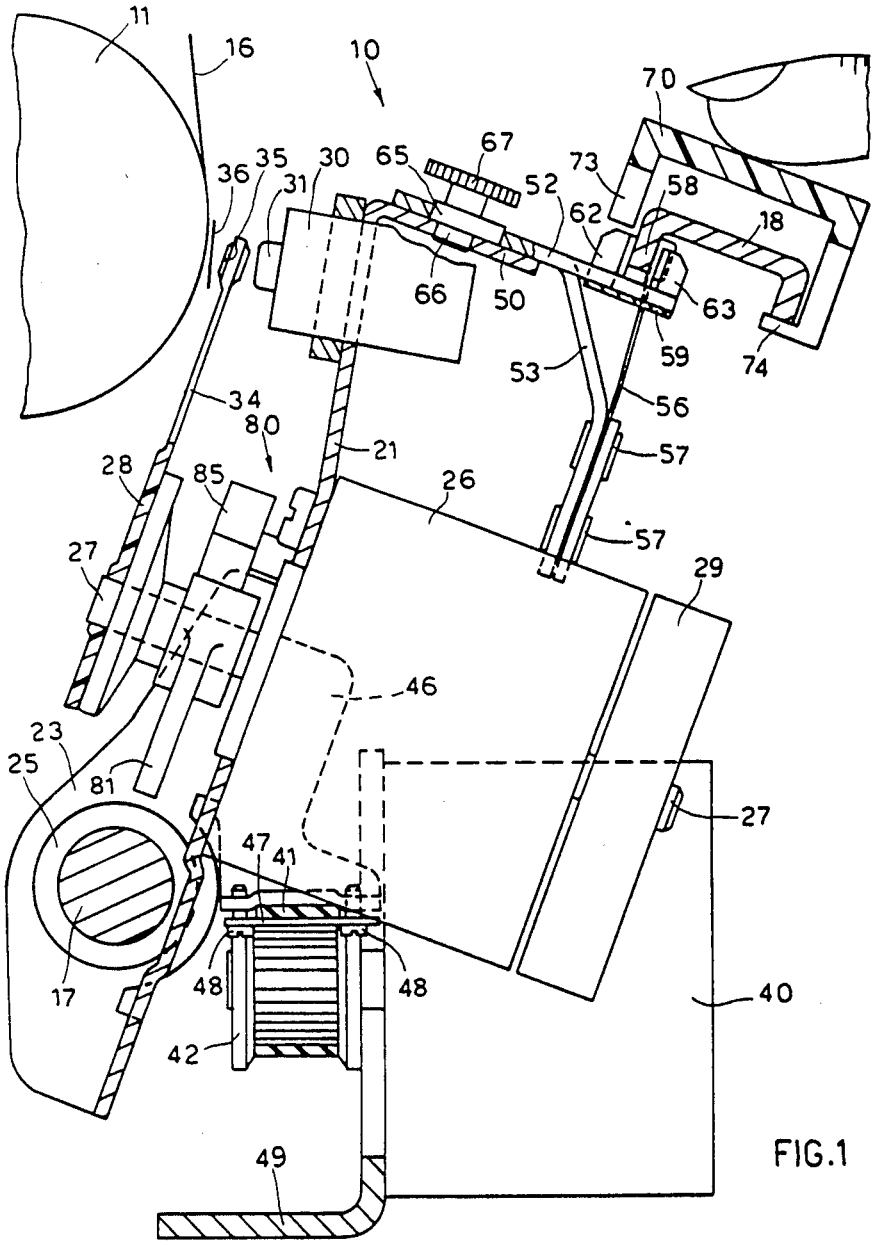
Figure 2:
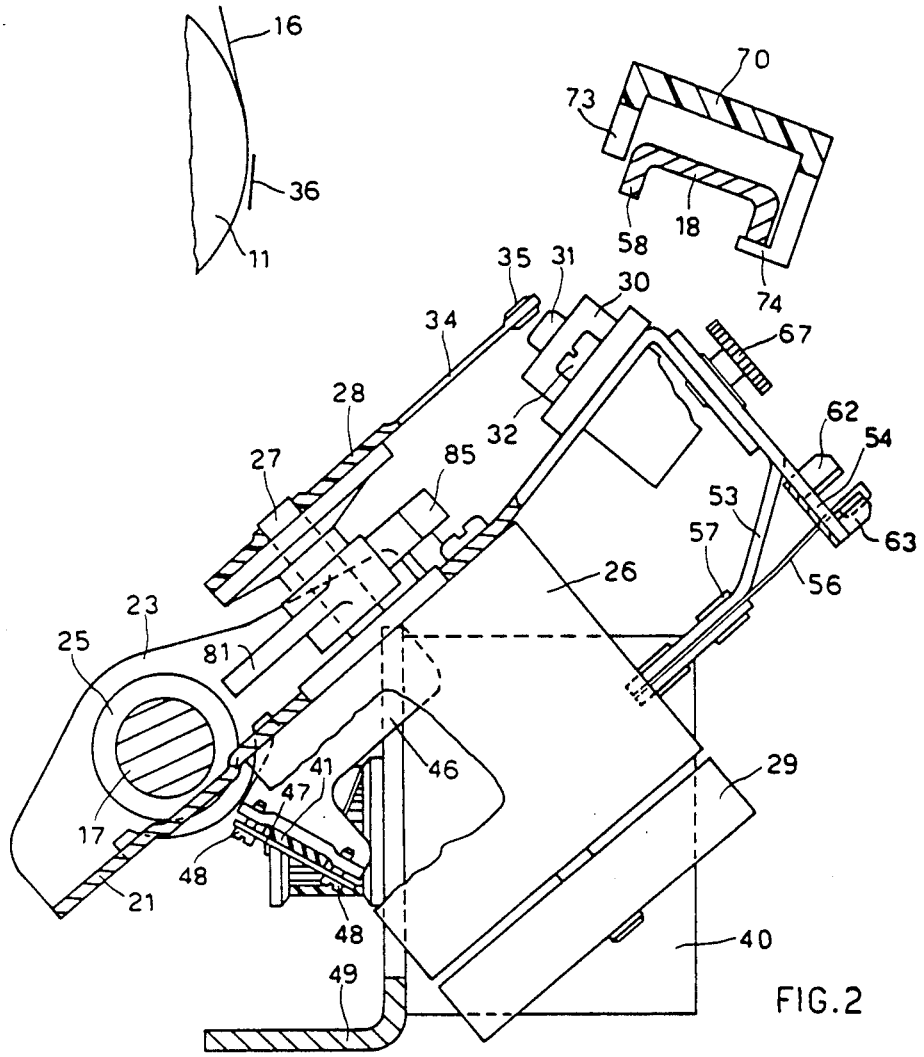
Figure 3:
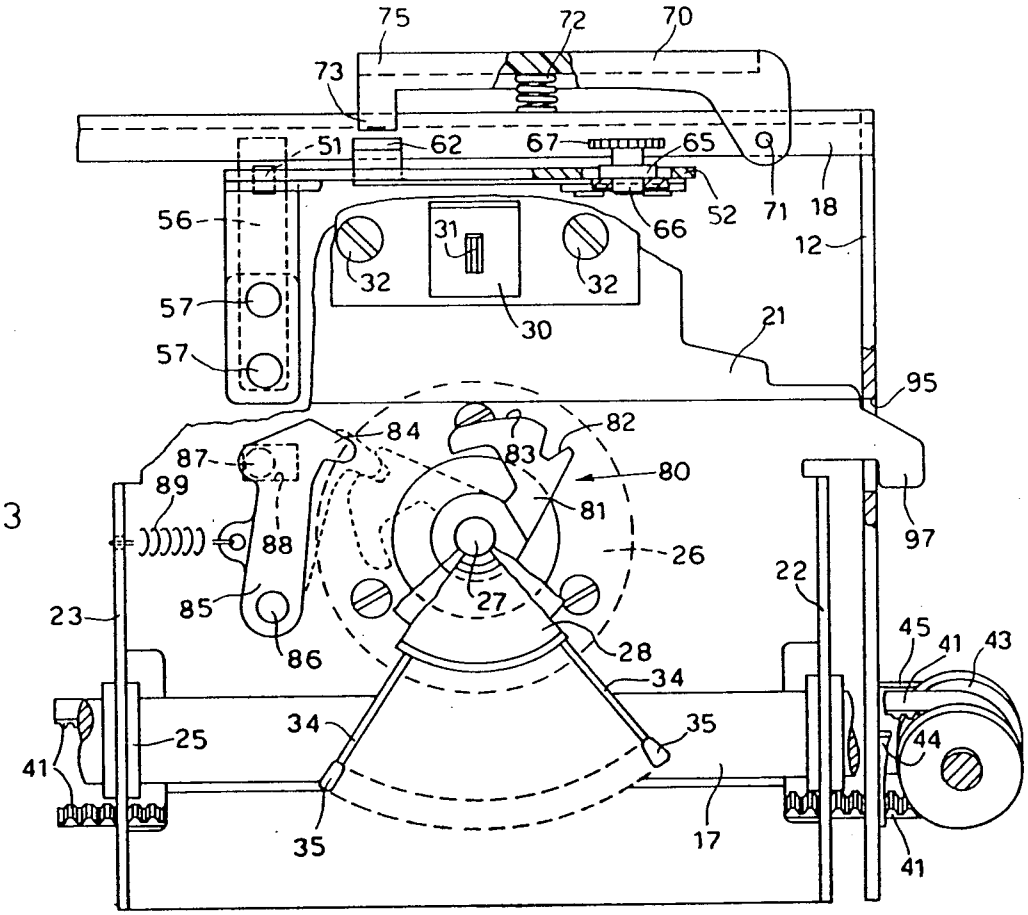
Figure 4:
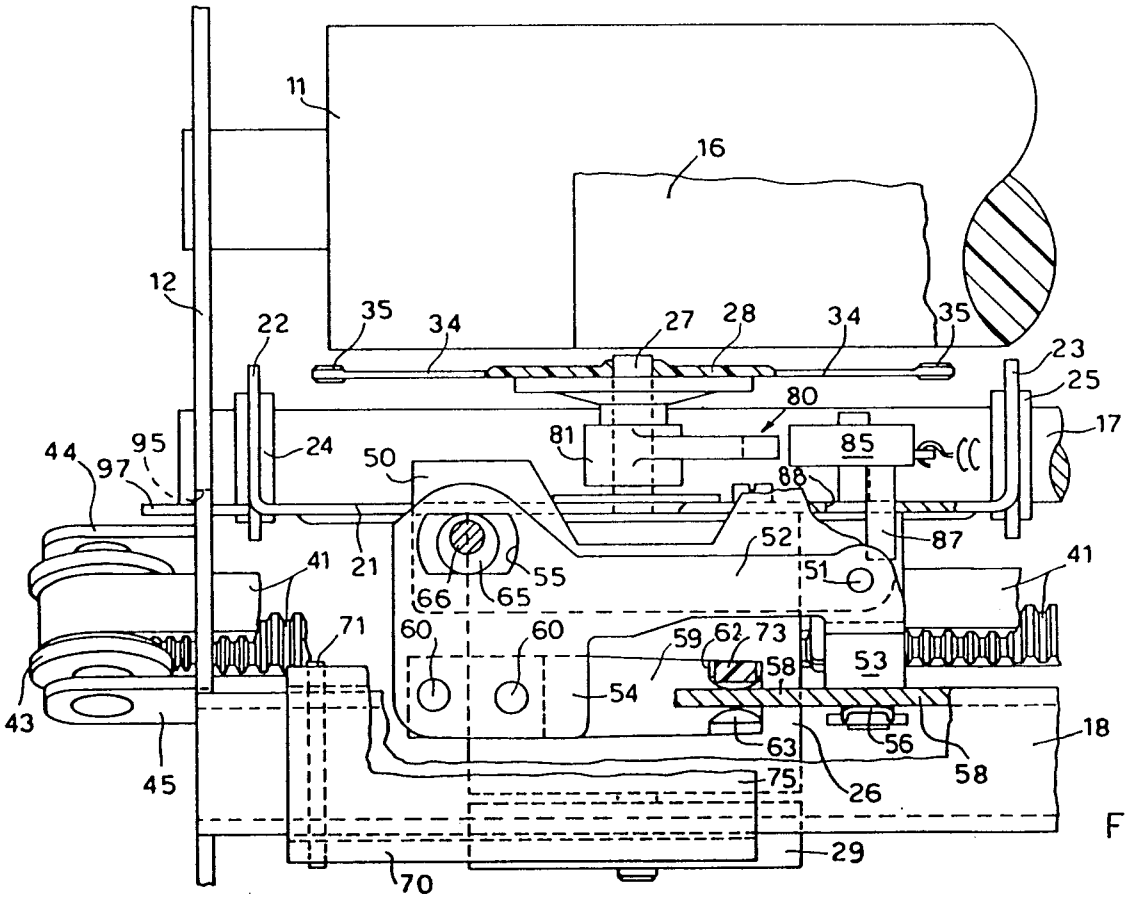
Figure 5:
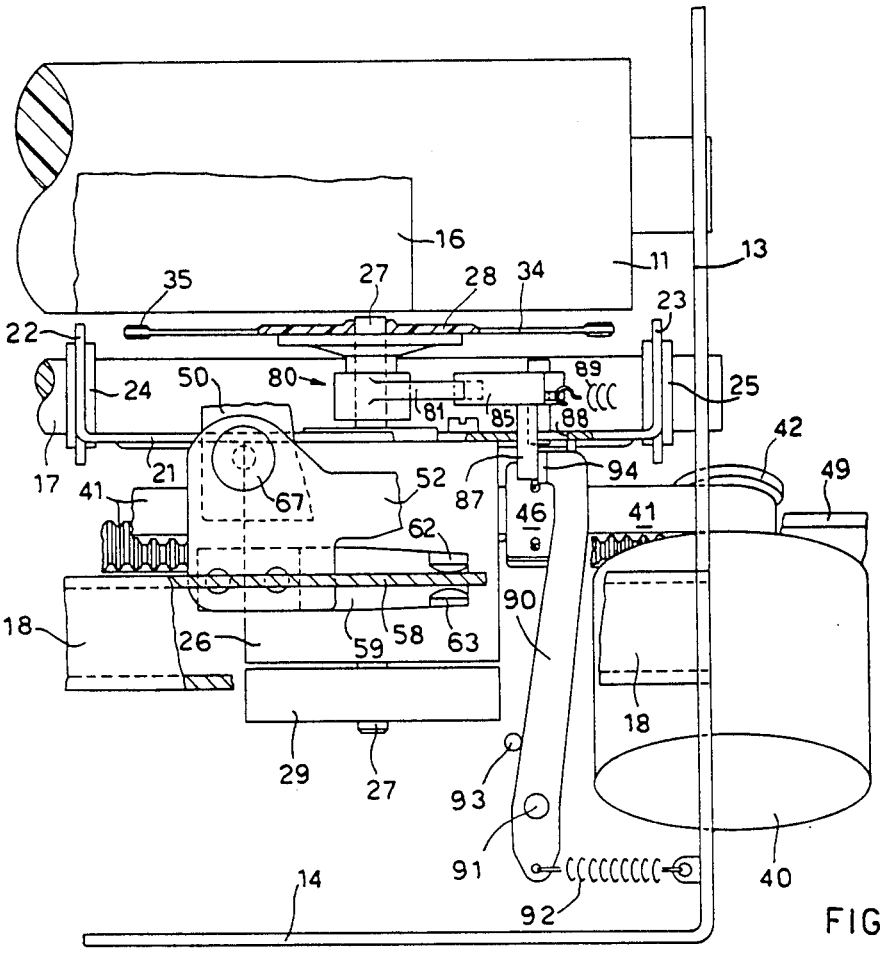
Figure 6:
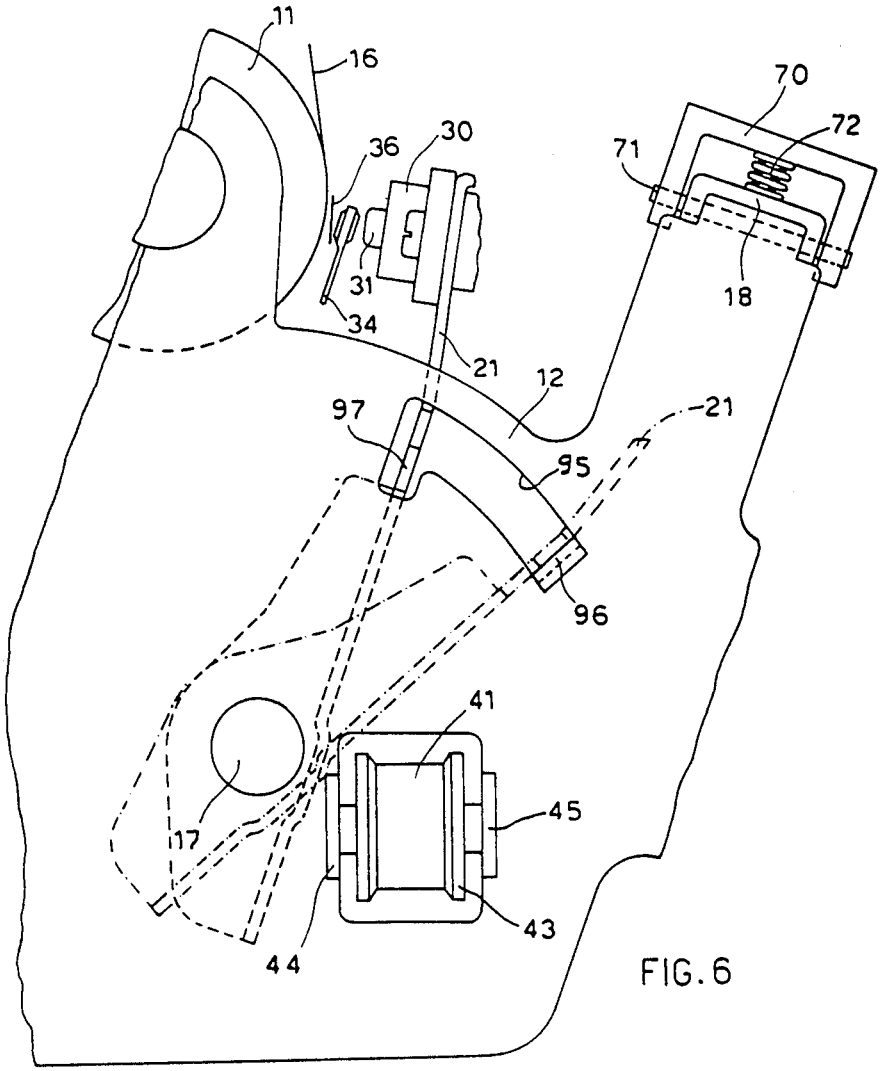

The invention will be described in more detail, by way of example, with reference to the accompanying drawings, in which:

FIG. 1 is a partly sectional side view from the left-hand side of a serial printer embodying the invention, with the carriage in an operating position, FIG. 2 is a partly sectional view from the left-hand side and on a reduced scale of the printer shown in FIG. 1, with the carriage in a service position, FIG. 3 is a partly sectional rear view on a reduced scale of the printer shown in FIG. 1, FIG. 4 is a partly sectional plan view on a reduced scale of the printer shown in FIG. 1, illustrating the carriage when it is moved towards the left-hand side of the frame structure, FIG. 5 is a partly sectional plan view on a reduced scale of the printer shown in FIG. 1, showing the carriage when it is moved towards the right-hand side of the frame structure, and FIG. 6 is a partly sectional view from the left-hand side of the printer embodying the invention, showing the left-hand side portion of the frame structure and the operating and service positions of the carriage.

Referring to FIG. 1, a serial printer 10 according to the invention comprises a platen roller 11 which is mounted rotatably on two side portions 12 and 13 (see FIGS. 4 and 5) of a frame structure 14, and is capable of holding in position a recording carrier 16 which comprises for example a sheet of paper.

Mounted on the side portions 12 and 13 are a cylindrical guide 17 and a bar 18 which is of inverted U-shaped cross-section (see FIGS. 1 and 2), the guide 17 and the bar 18 being parallel to the platen roller 11.

A carriage 21 which is so shaped as to have two side portions 22 and 23 is mounted slidably on the guide 17 by means of two bushes 24 and 25. Mounted in turn on the carriage 21 is a selector motor 26 of stepping type, having a shaft 27 on which there is removably carried a character carrying disc 28 having flexible blades, of known type, for example as described in Italian Pat. No. 1 016 552 which was issued to the present applicants on June 20, 1977. In particular, a print character 35 is disposed in raised form at the end of each blade 34.

Associated with the selector motor 26 is an arrangement 29 which is arranged to damp the oscillations of the shaft 27. The arrangement 29 is also of known type, being for example of the type described in Italian patent application No. 67219-A/81 filed by the present applicants on Feb. 17, 1981.

A striker arrangement 30 comprising a hammer 31 is mounted on the carriage 21 by means of screws 32 (see FIG. 3).

An inked ribbon 36 is disposed in front of the platen roller 11 (see FIGS. 1 and 2).

Translatory movement of the carriage 21 in front of the platen roller 11 is controlled by a motor 40 which is also of stepping type, by means of a toothed belt 41. The motor 40 is fixed to a rib member 49 of the frame structure 14 (see FIGS. 1, 2 and 5) and the belt 41 is tensioned between two toothed pulleys 42 and 43 of which one is mounted on the shaft of the motor 40 and the other is rotatable between two limb portions 44 and 45 (see FIGS. 3, 4 and 6) on the left-hand side portion 12 of the frame structure 14. The belt 41 is fixed to a bracket 46 on the carriage 21 by means of a clamp 47 and screws 48.

On its top, the carriage 21 is provided with a horizontal limb portion 50 (see FIGS. 1 to 5), while pivotally mounted on a pivot pin 51 thereon is a lever 52 which is of such a configuration as to have a lower bent portion 53, an arm 54 and a slot 55.

A substantially vertical flexible blade 56 is fixed to the portion 53 of the lever 52 by means of two rivets 57 and is arranged to co-operate with the internal part of one flange 58 of the bar 18.

A second substantially horizontal flexible blade 59 is fixed to the arm 54 of the lever 52 by means of two rivets 60 and at one end carries two slider members or shoes 62 and 63 which are arranged to co-operate with the flange 58 of the bar 18.

An eccentric portion 65 of a pin 66 co-operates with the slot 55 in the lever 52. The pin 66 is mounted rotatably on the limb portion 50 of the frame structure 20 and at its top carries a milled wheel or knob 67.

A key or button 70 (see FIGS. 3 and 4) is pivoted on a pivot pin 71 on the bar 18, in the vicinity of the left-hand side portion 12 of the frame structure 14. At one end 75, the key 70 is provided with two teeth 73 and 74 on its underside. The tooth 73 is arranged to co-operate with the slider member 62 of the carriage 21 to disengage it from the flange 58 of the bar 18, as will be described in greater detail hereinafter, while the tooth 74 normally co-operates with the lower part of the bar 18, due to the force of a coil spring 72 which is disposed between the key 70 and the actual bar 18.

The printer according to the invention is also provided with a mechanism 80 for positioning and zeroing the character carrying disc 28 and the shaft 27 of the selector motor 26.

In particular, the mechanism 80 comprises an element 81 of plastics material (see FIGS. 1, 3, 4 and 5) which is fitted or keyed on the shaft 27 and which is of such a configuration as to have a substantially V-shaped recess 82 and a cam profile 83. A tooth 84 on a stop lever 85 is arranged to co-operate with the element 81. The lever 85 is pivotally mounted on a pivot pin 86 on the carriage 21 and has a pin or peg 87 which is housed within a slot 88 in the carriage 21. A spring 89 normally holds the lever 85 and the tooth 84 away from the position of blocking the element 81 so that the latter is able freely to rotate together with the shaft 27 and the character carrying disc 28.

Disposed in the vicinity of the right-hand side portion 13 of the frame structure 14 (see FIG. 5) is a lever 90 which is pivotally mounted on a fixed pivot pin 91 and which is urged by a spring 92 against a fixed stop 93. The lever 90 has a lug portion 94 co-operable with the peg or pin 87 on the lever 85 when the carriage 21 is moved into the right-hand extra-margin position, as will be described hereinafter.

The carriage 21 is capable of occupying two stable positions, one being an operating position as shown in FIG. 1 and the other being a service position as shown in FIG. 2. Those positions are defined by a slot 95 which is provided in the left-hand side portion 12 of the frame structure 14 (see FIG. 6), and provided at one end with a stop member 96 against which the carriage 21 will bear when in the service position.

The carriage 21 is also provided with a hook 97 (see FIGS. 3, 4 and 6) which, co-operating with the slot 95 in the side portion 12, permits the carriage to move in front of the platen roller 11 only when it is in the operating position, but blocking it when it is in the service position. The amplitude of the pivotal movement of the carriage 21 between the two positions is about 30°.

The mode of operation of the serial printer 10 as described hereinbefore is as follows:

Under normal operating conditions, the carriage 21 is in the position shown in FIG. 1 with the slider members 62 and 63 and the blade 56 co-operating with the flange 58 of the bar 18. The blade 56, by the action thereof, tends to urge the carriage 21 away from the roller 11 and thus holds the slider member 62 against the flange 58, thus making up for any clearances between the slider members 62 and 63 and the flange 58. Precise adjustment of the distance of the characters 35 of the disc 34 and the hammer 31 from the platen roller 11, in dependence on the number of copies to be printed, is effected by means of the knob 67. In fact, by rotating the latter with respect to the limb portion 50 of the carriage 21, by virtue of the connection between the eccentric portion 65 and the slot 55, a reciprocal movement is produced as between the lever 52 and the carriage 21, and, since the slider members 62 and 63 are engaged with the flange 58, it is the carriage 21 which actually moves with respect to the platen roller 11. In that operating position, the carriage 21 is free to move with a translatory movement in front of the platen roller 11 by means of the motor 40, by way of the belt 41. The individual characters are printed in known manner, with the striker hammer 31 being actuated when the character to be printed has been moved into the print position, between the platen roller 11 and the hammer 31, by the selector motor 26. It should be appreciated that impact of the selected character 35 against the platen roller 11 is always positively backed up by the slide member 62 which is in contact with the fixed bar 18.

When the character carrying disc 28 is to be removed, in order possibly to replace it, it is necessary first of all to move the carriage 21 to a position at the left-hand side portion 12 of the printer (see FIGS. 3 and 4). In that position, the hook 97 of the carriage 21 is inserted into the slot 95 in the side portion 12 and the slider member 62 is disposed precisely under the tooth 73 on the key or button 70.

The key or button 70 is then manually depressed, causing it to rotate on its mounting pin 71 against the force of the spring 72. The blade 59 flexes due to the tooth 73 applying a thrust force against the slider member 62 and, when the latter is completely released from the flange 58 of the bar 18, the carriage 21 rotates downwardly (in the clockwise direction in FIG. 1), due to the force of gravity. Such rotary movement is completed when the hook 97 is arrested against the rubber stop 96 in the opening 95 (see FIG. 6).

In that position, defined as the service position, the carriage is disposed with the hammer 31 and the character carrying disc 28, spaced from the platen roller 11 (see FIG. 2) whereby the disc 28 can be easily removed upwardly by the operator.

In that position moreover, the carriage 21 cannot move with a translatory movement, the hook 97 thereof being engaged with the left-hand side portion 12 of the frame structure 14.

Finally it should be noted that the belt 41, although it is caused to flex by the movement of the carriage 21, does not suffer permanent deformation due to its elasticity and due to the sufficient distance between the pulleys 42 and 43 and the bracket 46.

Once the character carrying disc 28 has been removed and replaced, the carriage 21 is easily returned to the operating position by causing it manually to rotate on the cylindrical guide 17 (in the anti-clockwise direction in FIG. 1). To do that, the key or button 70 must be released so that the tooth 73 thereof does not present an obstacle to engagement of the slider members 62 and 63 with the arm 58 of the bar 18. The engaged condition of the slider members 62 and 63 with the flange 58 is attained readily, in that the outside side portion of the slider member 62, being bevelled, once it comes into contact with the flange 58, causes the blade 59 to bend downwardly.

After the carriage 21 is returned to its normal operating position, the printer 10 performs a cycle for zeroing of the character carrying disc 28. That cycle provides for a complete translatory movement of the carriage 21 from the left-hand side portion 12 to the right-hand side portion 13 of the frame structure 14, by means of the motor 40.

When the carriage 21 (see FIG. 5) reaches the vicinity of the side portion 13, the peg 87 on the lever 85 comes into contact with the lug portion 94 on the lever 90. Since the force of the spring 92 is greater than that of the spring 89, the peg or pin 87 is stopped, thus causing a reciprocal movement as between the carriage 21 which continues to advance towards the side portion 13, and the stop lever 85. In fact, the latter is caused to rotate about its pivot pin 86 in the clockwise direction (see FIG. 4) and is moved into the position shown in broken lines. The amplitude of that rotary movement is defined by the opening 88. The selector motor 26 is then actuated in such a way that the shaft 27 thereof rotates in an anti-clockwise direction (still with reference to FIG. 4) until the tooth 84 on the lever 85 engages into the recess 82 in the element 81, assisted by the cam profile 83. After a predetermined period of time, the motor 26 is de-energised and the position attained by the element 81 which is coupled to the lever 85 is assumed as the angular reference position of the character carrying disc 28.

After that zeroing cycle, the printer 10 is ready to print graphic symbols and characters on the recording carrier 16.

It will be clear from the present description that the printing carriage 21 is mounted slidably on the guide 17 that is parallel to the platen roller 11 and has a slidable element 62 co-operating with the fixed bar 18 that is parallel to the guide 17 to hold the carriage in an operating position, and that a release or disengagement member 70 is mounted on the fixed bar 18 and is arranged to co-operate with the slidable element 62 when the carriage 21 is in a predetermined position whereby selective actuation of the member 70 causes disengagement of the connection between the element 62 and the bar 18 and permits the carriage 21 to be inclined with respect to the guide 17 from the operating position to a service position in which there is ready access to the character carrying disc 28 from above.

It will be apparent that the serial printer as described hereinbefore may be the subject of modifications and addition of parts without thereby departing from the scope of the present invention.

For example, the slider member 62 may be replaced by a roller which is mounted rotatably on a pin fixed to the free end of the flexible blade 59.

What we claim is:

1. A serial printer comprising:

a platen;

a fixed guide disposed below said platen and parallel thereto;

a fixed bar disposed in front of said platen and parallel thereto;

a printer carriage having a front portion and a rear portion;

means for slidably mounting said rear portion of said print carriage on said fixed guide;

a sliding element mounted on said front portion of said print carriage and cooperating with said fixed bar for holding said print carriage normally leaned against said fixed bar in an operative printing position with respect to said platen;

means for translating said print carriage along said fixed guide from a rest position towards a plurality of printing positions along said platen when said carriage is in said operative printing position; and a release member mounted on said fixed bar for cooperating with said sliding element when said print carriage is in said rest position for selectively disconnecting said sliding element from said bar and allowing an automatic swing of said print carriage about said fixed guide from said operative position to a service position, wherein said sliding element comprises a slider member cooperative with said fixed bar and a first flexible blade substantially parallel to said fixed bar and having a first end connected to said front portion of said print carriage and a second end connected to said slider member, wherein said first flexible blade is normally in a rest position in which said slider member cooperates with said fixed bar, and wherein said flexible blade is flexible by means of said release member from its rest position to an actuated position in which said slider member is disengaged from said fixed bar.

2. A serial printer according to claim 1, wherein said fixed bar comprises a first and a second surface substantially parallel to said platen, and wherein said sliding element further comprises a second flexible blade substantially perpendicular to said fixed bar, said second flexible blade having a first end connected to said first portion of said print carriage and a second end cooperating with said first surface of said fixed bar for normally holding said slider member in contact with said second surface of said fixed bar.

3. A serial printer according to claim 2, wherein both said first ends of said first and second blades are fixed to a single lever which is pivotally mounted on said front portion of said print carriage.

4. A serial printer according to claim 3, wherein a manually actuable mechanism is interposed between said single lever and said print carriage for varying the distance between said print carriage and said platen, while maintaining the distance between said lever and said fixed bar constant.

5. A serial printer according to claim 1, wherein said release member comprises a depressable key which is pivotally mounted on said fixed bar in a determined position and which has a tooth capable of cooperating with said slider member when said print carriage is in said rest position, to bend said first flexible blade from its rest position to said actuated position.

6. A serial printer according to claim 5, wherein said fixed bar is mounted between two side portions of a frame structure, and wherein said key is disposed in a position corresponding to one of said two side portions.

* * * * *